US005868593A

United States Patent [19]

Feng

[11] Patent Number: 5,868,593

[45] Date of Patent: Feb. 9, 1999

[54] FLIPPER STRUCTURE

[76] Inventor: Le-Jang Feng, No. 22-10, Lane 50, Tien Mu E. Rd., Taipei, Taiwan

[21] Appl. No.: 44,393

[22] Filed: Mar. 18, 1998

[30] Foreign Application Priority Data

Nov. 10, 1997 [CN] China ..... 86218848

[51] Int. Cl.[6] ..... A63B 31/08

[52] U.S. Cl. ..... 441/64

[58] Field of Search ..... 441/61–64

[56] References Cited

U.S. PATENT DOCUMENTS 3,315,286 4/1967 Brion ..... 441/64

4,209,866 7/1980 Loeffler ..... 441/64

FOREIGN PATENT DOCUMENTS 351204 2/1961 Switzerland ..... 441/64

*Primary Examiner*—Jesus D. Sotelo

*Attorney, Agent, or Firm*—Pro-Techtor International Services

[57] ABSTRACT

A flipper structure including a web portion and a shoe portion. There is an opening between the web and the shoe so that the two portions are connected at only two points on their sides. The flipper structure allows a wearer to swing the web portion during swimming or diving by manipulating an area of his foot near his ankle instead of using only his toes. This allows the wearer to swim or dive for a prolonged time and to avoid possible cramps and injury.

2 Claims, 6 Drawing Sheets

FLIPPER STRUCTURE

BACKGROUND OF THE INVENTION

The present invention relates to an improved flipper structure, and more particularly to a flipper structure which allows a wearer to control the flipper by manipulating his or her ankle instead of toes, so that the wearer may swim or dive in an effort-saving manner and any possible athletic injury can be minimized.

Generally, a flipper includes a shoe portion and a web portion. The shoe portion receives a wearer's one foot therein. The web portion can be swung upward and downward by the wearer's foot to increase the thrust of leg movements in swimming. Usually, a swimmer or diver wearing flippers shall exert force on the web portions to swing the same by moving his or her feet.

Please refer to FIG. 1 which illustrates a flipper with conventional structure. The shoe portion 1 and the web portion 2 are integrally formed with a front end of the shoe portion 1 completely connected to the web portion. As shown in FIG. 2, a point A on a wearer's foot 6 in the shoe portion 1 to exert force on the web portion 2 is generally close to and contacts with a joint between the shoe portion 1 and the web portion 2. That is, an area on each flipper to there a force is applied to swing the web portion almost concentrates at the front end of the shoe portion 1, also a place at where the wearer's toes 61 locate. In other words, a main area on the wearer's foot from where force is exerted on the flipper to swing the web portion is the toes at front end of the foot. Any reaction of the web portion 2 also acts on the toes. Since the toe joints are very weak areas on the foot and tend to become tightened and curled when the wearer tries to exert force from these areas and when these areas are subjected to force from the swung web portion 2, as shown in FIG. 3. This condition will not only cause sore and ache toes 61 but also ache and cramped calves. The swing of the web portion 2 with toes 61 also consumes more energy and prevents the swimmer or diver from swimming or diving for a prolonged time. It is therefore desirable to improve the conventional flipper structure.

SUMMARY OF THE INVENTION

It is a primary object of the present invention to provide an improved flipper structure to eliminate the drawbacks existing in the conventional flipper structure. In the flipper structure of the present invention, the front end of the shoe portion is not integrally connected to the web portion. The shoe portion and the web portion are connected to one another only at their two sides. That is, the shoe portion and the web portion are connected to one another at their two sides but not at any area across between them. With this structure, the force exerted by the wearer to swing the web portion mainly comes from two sides of the foot near the ankle instead of from the toes at front end of the foot. Since the ankle area is stronger than the toe area in respect of exerting and withstanding force, to swing the web portion with the ankle area may avoid sore and ache toe joints and/or other possible athletic injury. The calf is not subject to cramp and the swimmer or diver may save more energy to swim or dive for a prolonged time.

DETAILED DESCRIPTION OF THE PREFERRED EMBODIMENTS

Figure 4:
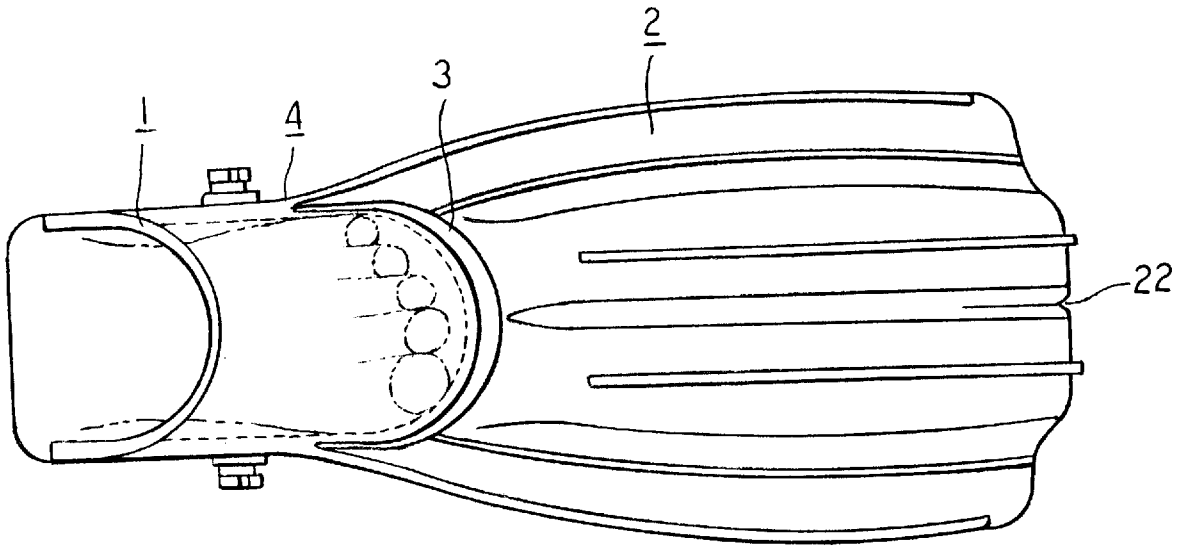
FIG. 4 shows a first embodiment of a flipper according to the present invention.
Figure 6:
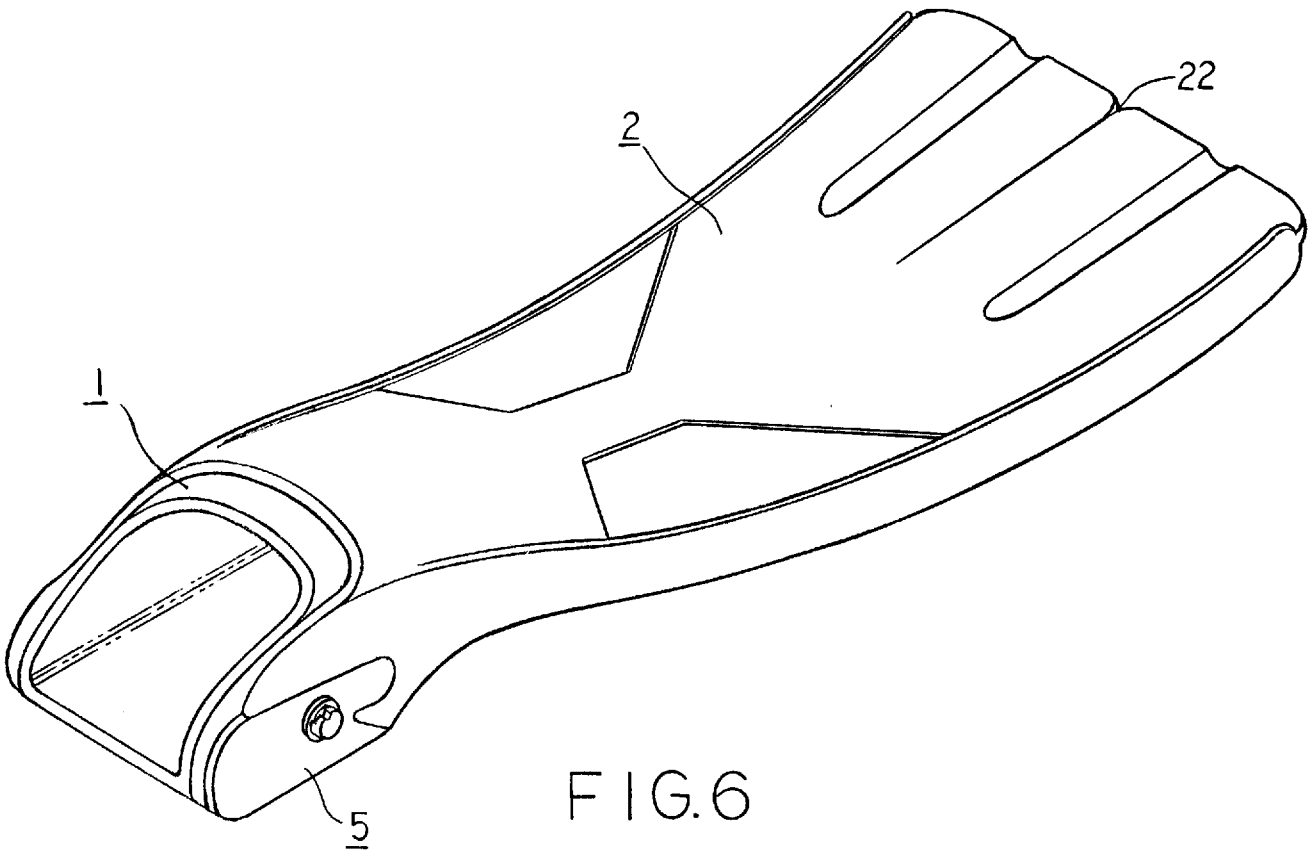
FIG. 6 is a perspective of another embodiment of the flipper according to the present invention.
Figure 7:
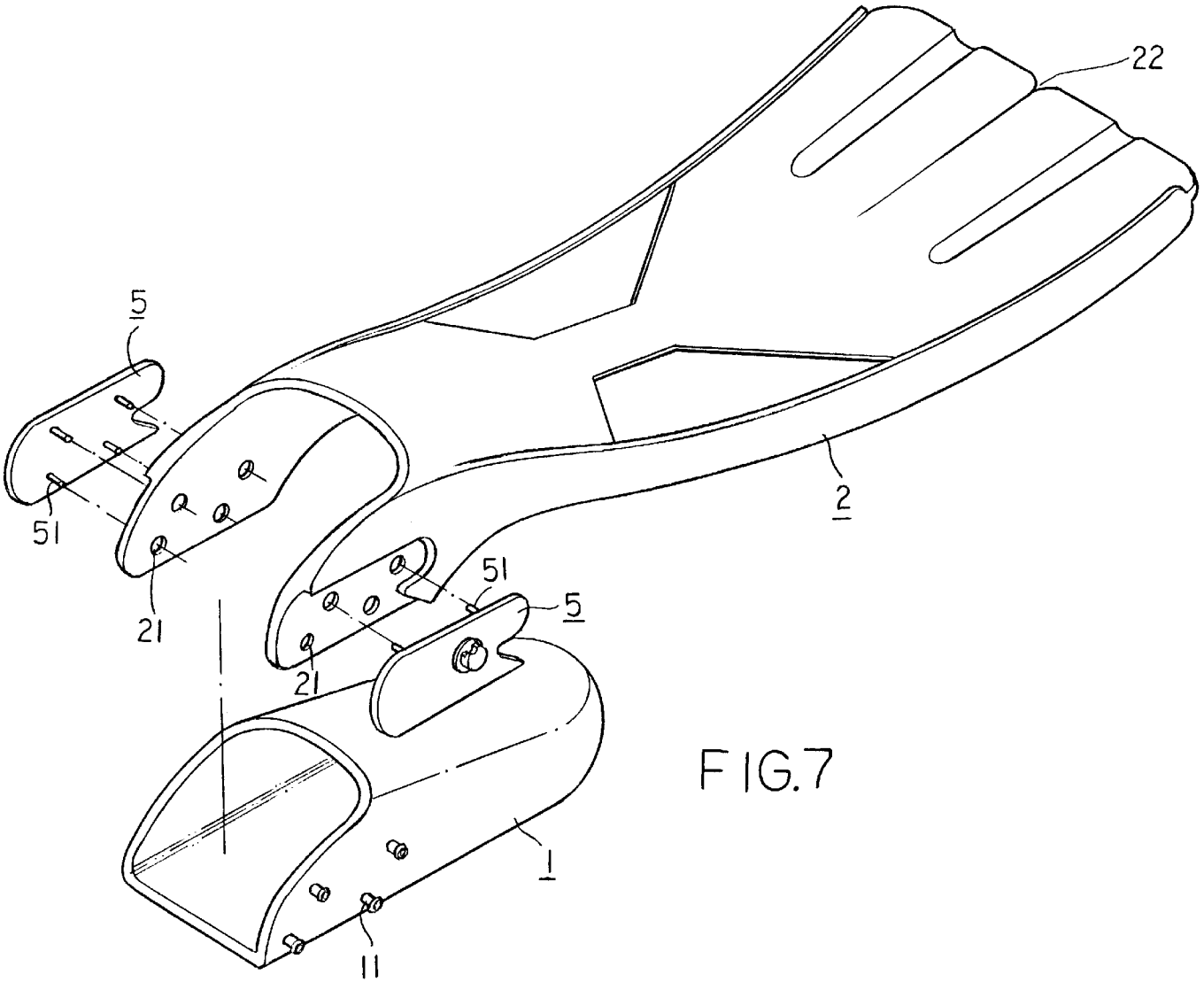
FIG. 7 is an exploded perspective of the flipper of FIG. 6.
Figure 8:
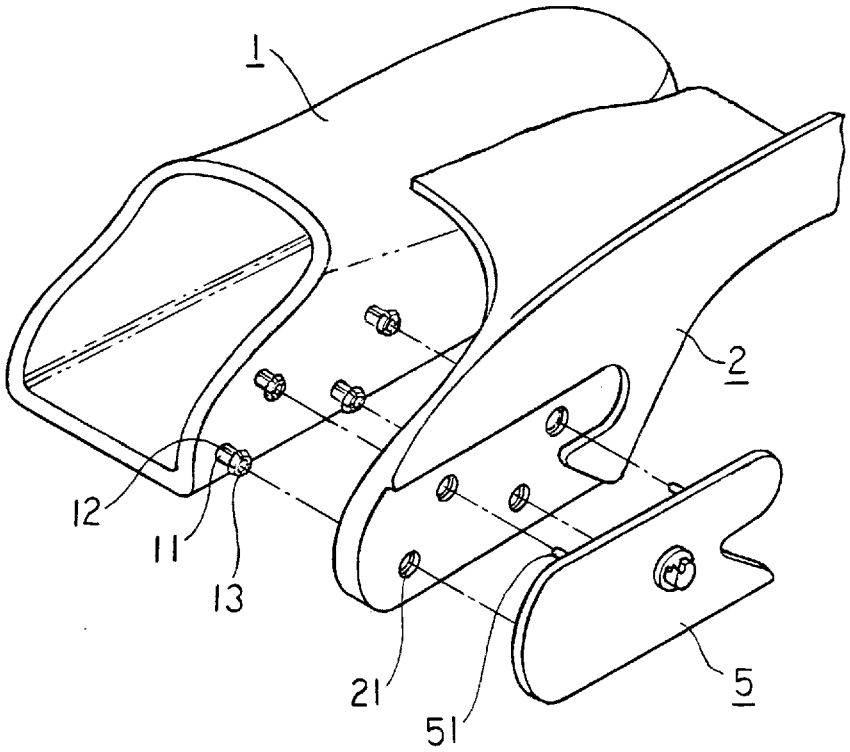
FIG. 8 is a fragmentary, exploded perspective of the flipper of FIG. 6 to particularly show the joint of the shoe portion and the web portion thereof.
Figure 9:
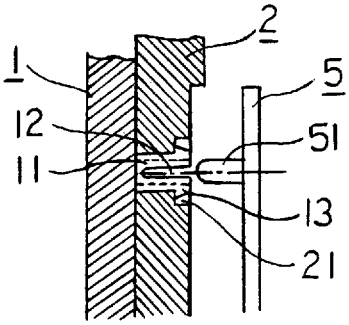
FIG. 9 is a fragmentary, sectional view of the flipper of FIG. 6 to particularly show the joint of the shoe and web portions thereof.

Please refer to FIG. 4 which shows a first embodiment of a flipper having a structure according to the present invention. The flipper includes a shoe portion 1 and a web portion 2. An area of the flipper between a front end of the shoe portion 1 and the web portion 2 is cut away to form an arcuate opening 3 substantially corresponding to the contour of toes. The shoe portion 1 and the web portion 2 are connected to one another at two sides 4 of the flipper.

Figure 1:
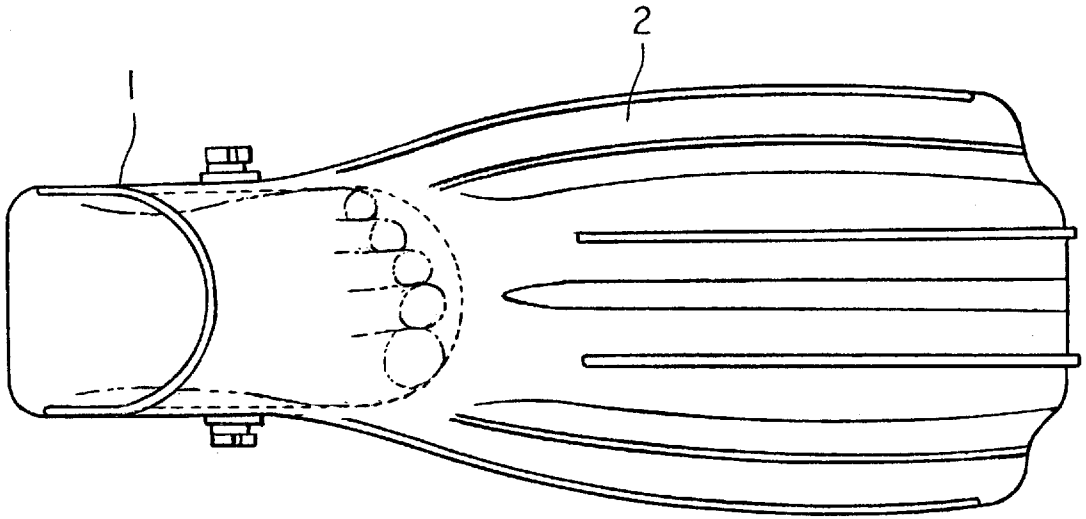
FIG. 1 (Prior Art)
FIG. 1 shows a flipper with conventional structure.
Figure 2:
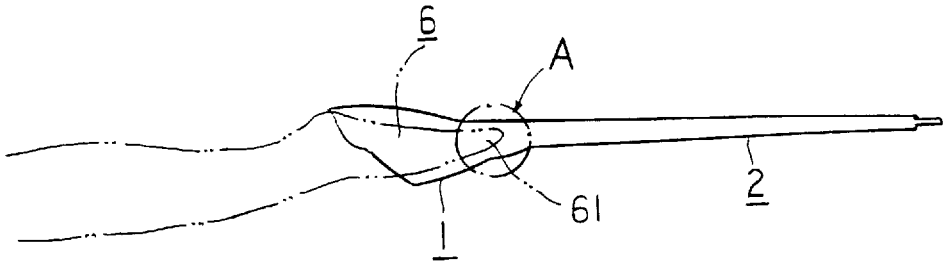
FIG.2 (Prior Art)
FIG. 2 is a schematic view showing the control of the conventionally structured flipper.
Figure 3:
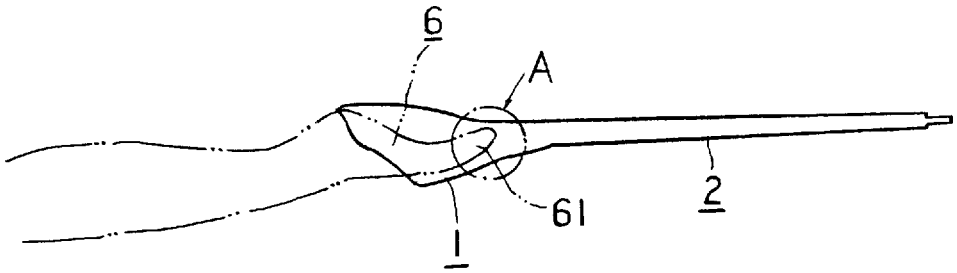
FIG.3 (Prior Art)
FIG. 3 is another schematic view showing the control of the conventionally structured flipper.
Figure 5:
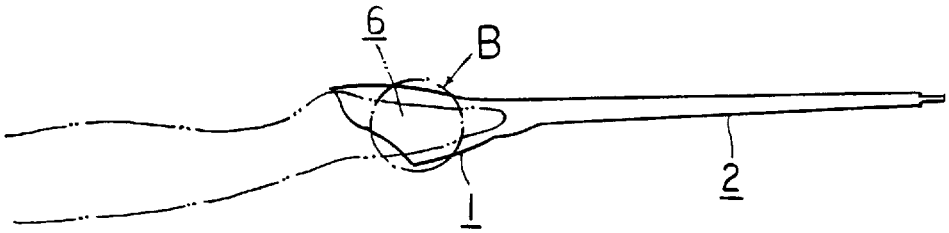
FIG.5 (Prior Art)
FIG. 5 is a schematic view showing the control of the flipper according to the present invention.

To swing the web portions 2 in swimming or diving, a wearer uses areas (B) of his or her feet 6 near the ankles, instead of the toe joints 61 at front ends of the feet, to exert force on the web portions 2, as shown in FIG. 5. Since the areas (B) on the feet near the ankles are stronger than the toe joints 61, the wearer may exert and withstand stronger force at the areas (B) to swing the web portions 2 with less efforts. This prevents sore and ache toe joints 61, cramped calves, or any possible athletic injury. The swimmer or diver wearing flippers of the present invention may swim or dive without consuming too much energy and may therefore swim or dive for a prolonged time while maintains good moving speed in the water.

FIGS. 6 to 9 show a flipper according to another embodiment of the present invention. In this embodiment, the flipper includes separately formed shoe portion 1 and web portion 2. Hollow studs 11 and connecting holes 21 are correspondingly provided at two sides of the shoe portion 1 and the web portion 2, respectively. The hollow stud 11 each has slits 12 on diametrically opposite sides thereof, allowing the hollow stud 11 to be elastically expanded and compressed, whereby a head portion 13 of the hollow stud 11 may easily pass through the connecting hole 21 to be retained thereto. Two connecting covers 5 are provided at two outer sides of the joint of the shoe and the web portions 1, 2. Each connecting cover 5 is provided on an inner surface with multiple insertion pins 51 corresponding to the connecting holes 21 on the web portion 2. The insertion pins 51 extend into the head portions 13 of the hollow studs 11 which have already passed through and been retained in the connecting holes 21. The insertion pins 51 in the hollow studs 11 expand the head portions 13 of the studs 11, forcing the studs 11 to tightly abut against inner walls of the connecting holes 21 without the risk of easily separating from the holes 21. These hollow studs 11, connecting holes 21, and connecting covers 5 are located on the flipper near two sides of a wearer's ankles, allowing the wearer to swing the web portions 2 of the flipper by manipulating his or her ankles in an effort-saving manner. Therefore, the wearer may swim or dive for a prolonged time. Moreover, since the web portions 2 are not integrally connected to the front ends of shoe portions 1, sore and ache toes and cramped calves can be minimized.

Since the shoe portion 1 and the web portion 2 are separate units in the second embodiment of the present invention, the shoe portion 1 may be manufactured to have many different sizes or specifications independent of the web portion 2. This enables the flippers to be produced at lower cost with increased value. In addition to the above-mentioned hollow studs 11 and connecting holes 21, the connection of the shoe portion 1 to the web portion 2 may also be effected by using other currently available fastening means, such as snaps, screws, adhesives, etc.

Please refer back to FIGS. 4 and 6. The web portion 2 according to the present invention is provided at its front or outer end with at least one axially extended water slit 22. When the web portion 2 of the flipper is swung in water, a part of water may quickly flow through the water slit 22, so that the flipper is more effectively propelled by the water and the wearer may swim forward at quicker speed.

In brief, the flipper having the structure according to the present invention may either have shoe and web portions integrally connected with one another at two sides of the flipper with an arcuate opening formed between the shoe and the web portions, or have separate shoe and web portions connected to one another at two sides by other fastening means, so that the wearer may swing the web portion by manipulating his or her ankle area instead of the toe joints. Swinging the web portion of the flipper by manipulating the ankle area is effort-saving and prevents sore and ache toes and cramped calves. And, water slits provided on the web portions allow the wearer to swim or dive at quicker speed.

What is claimed is:

1. A flipper structure comprising:

a shoe portion and a web portion, said web portion has two rear sides hingedly connected to two sides of said shoe portion by fastening means such that a rear edge of said web portion is not affixed to a front end of said shoe portion, thereby allowing a wearer to swing said web portion by moving a part of his foot near his ankle; and wherein said fastening means includes hollow studs and connecting holes provided on two sides of said shoe portion and said web portion respectively, said hollow studs include slits on diametrically opposed sides, thereby allowing head portions of said hollow studs to be elastically compressed and expanded when said head portions are inserted into said connecting holes, and wherein said fastening means further comprises connecting covers with insertion pins provided on inner surfaces thereof, said insertion pins are inserted into said head portions of said hollow studs such that said head portions of said hollow studs are elastically expanded by said insertion pins to tightly abut inner walls of said connecting holes.

2. The flipper structure as claimed in claim 1 wherein:

said web portion includes at a front or outer edge at least one axially extending water slit.

* * * * *